US006835945B2

(12) United States Patent
Mossor et al.

(10) Patent No.: US 6,835,945 B2
(45) Date of Patent: Dec. 28, 2004

(54) PORTABLE SHIELDING SYSTEM

(76) Inventors: David B Mossor, 908 W. Main St., Harrisville, WV (US) 26362; Ernest Seth, P.O. Box 15, Harrisville, WV (US) 26362

( * ) Notice: Subject to any disclaimer, the term of this patent is extended or adjusted under 35 U.S.C. 154(b) by 0 days.

(21) Appl. No.: 10/622,228

(22) Filed: Jul. 18, 2003

(65) Prior Publication Data

US 2004/0188638 A1 Sep. 30, 2004

Related U.S. Application Data

(60) Provisional application No. 60/397,231, filed on Jul. 19, 2002, and provisional application No. 60/405,785, filed on Aug. 22, 2002.

(51) Int. Cl.[7] ..... G21F 3/02

(52) U.S. Cl. ..... 250/515.1; 250/519.1; 141/10; 141/66; 141/97

(58) Field of Search ..... 250/515.1; 141/10, 141/66, 69

(56) References Cited

U.S. PATENT DOCUMENTS 3,844,083 A * 10/1974 Farley, Jr. ..... 52/645
4,090,087 A 5/1978 Weissenfluh ..... 250/519
4,360,736 A 11/1982 Weissenfluh ..... 250/519.1
4,362,948 A 12/1982 Weissenfluh ..... 250/519.1
4,504,739 A 3/1985 Weissenfluh ..... 250/519.1
4,555,880 A * 12/1985 Gzym et al. ..... 52/126.4
5,216,863 A * 6/1993 Nessa et al. ..... 52/439

OTHER PUBLICATIONS

Advertisement.

* cited by examiner

*Primary Examiner*—Nikita Wells
*Assistant Examiner*—James J. Leybourne
(74) *Attorney, Agent, or Firm*—Steptoe & Johnson PLLC

(57) ABSTRACT

A portable and modular shielding system having various modular wall components that can be interconnect to form a custom designed wall configuration, wherein the resulting wall provides shielding from radiation at its joints of two adjacent modular wall components as well as along its entire length. The principal modular wall component has a main container being generally rectangular in shape and a connector container being an elongated cylinder having a cross section that is generally circular in shape and being integrally connected to the second end of the main container. The first end of the main container is concave in shape and adapted to correspond to the generally circular shape of the connector container. A shielding wall is formed by interconnecting a connector container of a first modular wall component into a first end of a second modular wall component. The main container and connector container are hollow and are adapted to be filled with a filler material.

55 Claims, 16 Drawing Sheets

800

500

800

800

1000

1000

1300

PORTABLE SHIELDING SYSTEM

CROSS-REFERENCE TO RELATED APPLICATIONS

This application claims the benefit of U.S. Application Nos. 60/397,231 filed Jul. 19, 2002 and 60/405,785 filed Aug. 22, 2002.

BACKGROUND OF THE INVENTION

1. Field of the Invention

The present invention relates to wall systems, and in particular, to modular wall systems made of a plurality of interconnecting, wall components.

2. Related Art

As the demand for electrical power increases around the world, the development and use of nuclear reactors also increases. Accordingly, workers at such nuclear power plants have a great need for portable wall systems that prevent or minimize radiation emanating from a nuclear reactor itself and/or from activation products resulting from reactor operation because the workers often must go into areas of high radiation to perform required maintenance, inspections or repairs. Workers use such shielding wall systems as a means for protecting a designated work area within a nuclear power plant in order for the workers to work within the protected or shielded area without the worry of being exposed to high levels of radiation. In addition, federally required inspections of nuclear power plants necessitate open access to critical areas within the plant. Therefore, there is a need for a shielding system that is easily portable from one location to another while shielding persons within the protected area from unwanted radiation.

Early prior art shielding systems included lead sheets and concrete blocks, but neither of these were easily portable from one location to another. As a result, several patents were issued in attempts to solve the non-portability of these prior art systems. In U.S. Pat. No. 4,090,087 to Weissenfluh, a radiation shield is disclosed having a bag filled with a liquid radiation attenuating material suspended from a mobile carrier. Although an arguable improvement over the early prior art, there are disadvantages with the '087 system. First, the system cannot fully protect an individual working behind the shield because the bag does not provide complete coverage. There are open areas on all sides of the bag between the mobile carrier and the bag as well as between the ground and the bag. Therefore, unwanted radiation will stream around the shield and compromise the area sought to be protected. The system continues in stating that the filler liquid can be any hydrogenous material which may have a boron compound as a neutron absorber. Therefore, if there is a shortage of such filler material, repairs, inspections, or other work may halt until such filler material is found and brought to the area. Third; the bags are hung from the mobile carrier, as shown in FIG. 11. Thus, the heavy weight of the filler material may compromise the hooks or fasteners holding the bag in place. If the hooks happen to fail, the bag would fall to the ground, perhaps even burst open.

In U.S. Pat. No. 4,360,736 to Weissenfluh, a radiation shield is disclosed which improves upon the shielding system of the '087 system. Specifically, an improved bag is disclosed which has a means for connecting opposing walls of the bag, thereby ensuring a uniform thickness of the bag throughout its length when filled with a radiation attenuating liquid and hung on a mobile carrier. Despite this improvement to the bag, the radiation shielding system has the same disadvantages as described with the '087 system above.

In U.S. Pat. No. 4,362,948 to Weissenfluh, a radiation shield is disclosed being a freestanding container of a uniform thickness which is adapted to be used only with a radiation attenuating liquid. This shielding systems solves some of the problems with the prior '087 and '736 systems; however, it too has several disadvantages. First, the same problem exists in terms of having to use a radiation attenuating liquid. Second, the container has a fixed U-shape which cannot be altered according to the specific needs of the location sought to be protected. That is, if the target work area sought to be protected is in close proximity to walls, corners, stationary equipment, and the like, the pre-defined U-shape of the container may not work or fit within the confines of the target work area. Therefore, the '948 shielding system cannot be used.

In U.S. Pat. No. 4,504,739 to Weissenfluh, a method is disclosed for filling and emptying the shield system of the '948 patent. This method includes the introduction and emptying of both a gas and a radiation attenuating liquid to the container. Therefore, the same problem exists as with the other patented shielding systems described above.

Subsequent to these prior art patents, other commercially available shielding systems have been developed that use water as a filler material. However, as with the prior patented shielding systems, these conventional shielding systems all have a pre-defined shape such that each shape is targeted for a specific application. For example, there are hanging shields that operate as the container or bag of the '087 and '736 systems; there are U-shaped shields that operate as the free-standing container of '948 and '739 systems; and there are special form bags that conform to the exterior shape of a component piece of equipment, e.g., a section or intersection of pipes, and are intended to wrap and surround the target pipe or equipment.

The disadvantages with all of these prior art shield systems is that none of them are modular such that two or more components can be interconnected to form a unique shaped wall shielding system. By having predefined shapes, the use of the prior art shielding systems is limited. Therefore, there is a need for a portable and modular shielding system having component parts that interconnect to form a shielding wall of varying shapes and sizes.

Another disadvantage with the prior art shield systems is that there is no mechanism for interconnecting two or more shields while maintaining the shielding properties of the shields at the point of connection. For example, when placing two U-shaped shields next to each other in an attempt to protect a larger area, radiation may enter the protected area at the joint of the two adjacent shields. This is true whether the two shields overlapped each other (one placed in front of the other) or not. Therefore, there is a need for a portable and modular shielding system wherein two adjacent component shields maintain the integrity of the shield at their joint and prevent the protected area from seeing increased radiation levels.

Another prior art shielding system is shown in FIGS. 1(A), (B) and 2. In this system, a prior art shield component 100 is designed having a main container 112 with a first end 102 and a second end 104. She first end 102 is a receiving end and the second end 104 is a locking end. Specifically, the second end 104 has a cross-sectional shape that is generally circular wherein the diameter of the second end 104 is equal to the width or thickness of the main container 112. The first end 102 is concave in shape having a diameter and radius and is adapted to correspond to the generally circular shape of the cross section of the second end 104, such that the radius of the first end 102 is equal to the radius of the second end 104. In addition, the prior art shield component 100 is hollow so that it can be filled with any radiation attenuating material, e.g., water. Filling and draining of this prior art system is accomplished through an open port at the top of the shield section, making this an open system.

Using two or more prior art shield components 100, a user can build a prior art shielding wall 200 as shown in FIG. 2. For example, a first shield component 202, having a first (or receiving) end 206 and a second (or locking) end 208, is placed adjacent to a second shield component 204, also having a first (or receiving) end 210 and a second (or locking) end 212. As shown, the locking end 208 of the first shield component 202 is placed within the receiving end 210 of the second shield component 204, thereby creating a conventional "ball and socket" joint. Once in the proper position, the first shield component 202 can be secured to the second shield component 204 by conventional means.

The main disadvantage with the prior art shield components 100 and a resulting prior art shielding wall 200 is readily apparent at the joint 216 of the first shield component 202 and the second shield component 204. As the first shield component 202 rotates in relation to the second shield component 204 (that is, as the locking end 208 of the first shield component 202 rotates within the receiving end 210 of the second shield component 204), a gap 214 is created thereby compromising the integrity of the shielding wall 200 at that location. That is, at the gap 214 in the joint 216, there is less shielding protection for persons in the protected area because the level of protection is less than the width, or thickness, of each shield component 202, 204.

Therefore, there is still a need for a modular wall component that provides the same level of protection against radiation at its joints of two adjacent components as it does along the length of each such component.

SUMMARY OF THE INVENTION

The present invention is a modular and portable shielding system that solves the problems of the prior art shielding systems. A portable and modular shielding system is disclosed having various modular wall components that can be interconnected to form a custom designed shielding wall configuration, wherein the resulting wall provides shielding from radiation at its joints of two adjacent modular wall components as well as along its entire length.

There are four types of modular wall components in the present invention. The principal modular wall component is a main container being generally rectangular in shape and having a connector container, being an elongated cylinder, e.g., a tube, having a cross section that is generally circular in shape, integrally connected to the second end of the main container, thereby making it a locking end. The first end of the main container is concave in shape and adapted to correspond to the generally circular shape of the connector container, thereby making it a receiving end for the locking end of an adjacent modular wall component. A second modular wall component is a main container having a connector container on each of its ends. A third modular wall component is a main container wherein each of its ends is a receiving end for a connector container of an adjacent modular wall component. A fourth modular wall component is a main container wherein its first end is a receiving end for a connector container of an adjacent modular wall component and its second end is a straight end such that it can abut up to an existing flat wall or surface.

The modular wall components of the present invention may be hollow containers adapted to receive a filler material, e.g., water, or may be solid, e.g., concrete. Furthermore, one or more internal supports may be used to strengthen and ensure the shape of the modular wall components, as well as, one or more leg supports may be used to support a modular wall component in a free standing and upright position on a base surface, e.g., the ground.

In operation, a shielding wall is designed and built by interconnecting two modular wall components. That is, a connector container of a first modular wall component is fit and secured into a receiving end of a second modular wall component. This interconnection of two adjacent modular wall components is similar to a "ball and socket" joint. Therefore, an advantage of the present invention is that a custom-designed shielding wall may be built according to the restrictions of the area sought to be protected—the target area. The design simply uses the modular wall components needed for the specific target area. In addition, because a connector container can rotate within a receiving end of another modular wall component, two adjacent modular wall components can be interconnected at any angle up to 90 degrees in either direction. A mechanical fastener also can be used to further secure the two adjacent modular wall components.

Another advantage of the present shielding system is that the resulting shielding wall prevents radiation streaming at its joints. There are no open seams in the resulting shielding wall which would allow the unwanted radiation to penetrate. Also, the shielding wall has a uniform thickness along its entire length, even at its joints of two adjacent modular wall components. Therefore, the modular wall components of the present system provide a better shielded target area for workers.

Another advantage of the present invention is that a means to fill and drain the modular wall components may be positioned on the front face of the modular wall components. This allows for a first modular wall component to be stacked on top of a second modular wall component wherein the fill and drain means of the two modular wall components are connected.

DESCRIPTION OF FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

Figure 1A:
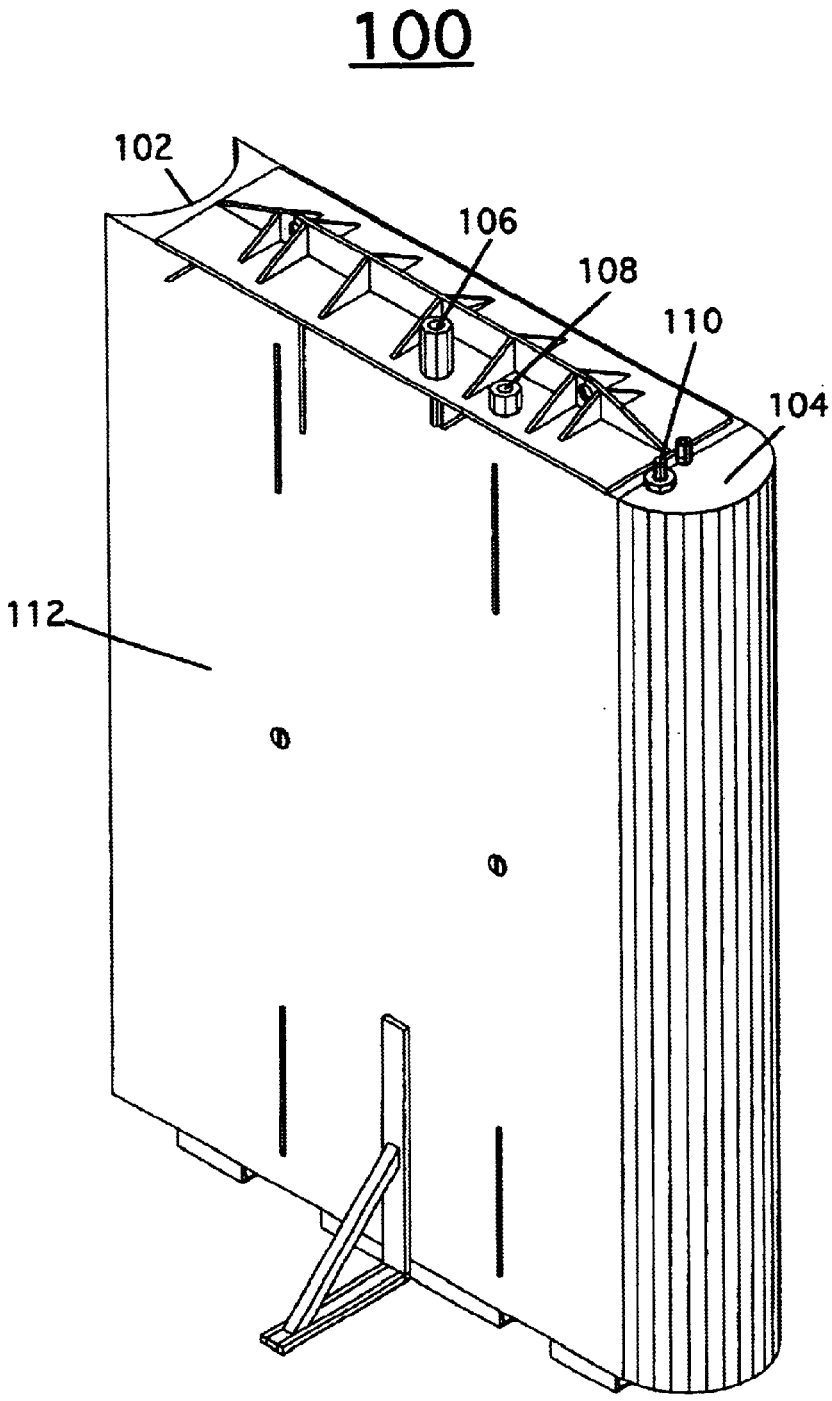
PRIOR ART FIG. 1(A)
FIG. 1(A) is a perspective diagram of the exterior of a prior art shield component.
Figure 1B:
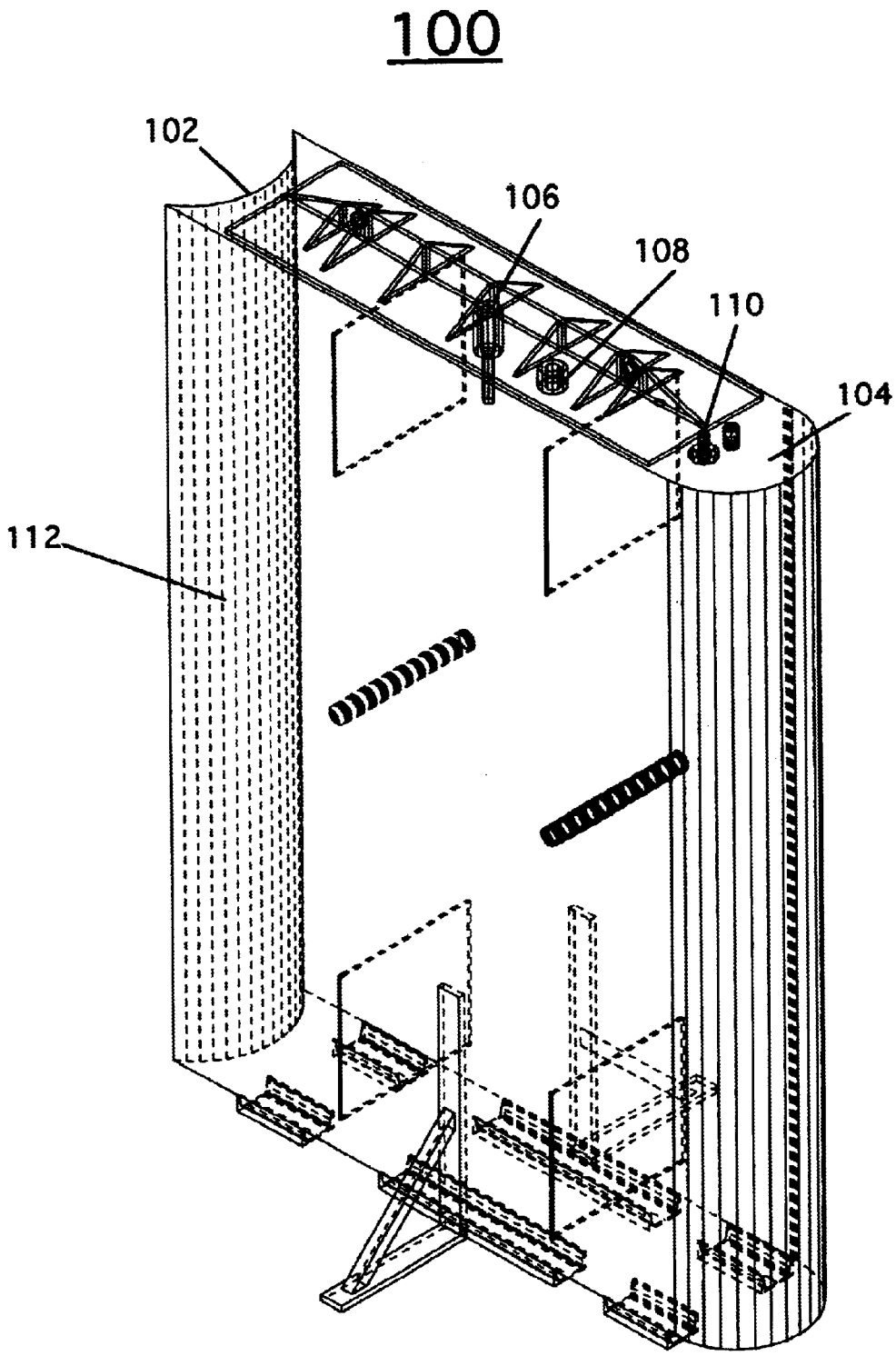
PRIOR ART FIG. 1(B)
FIG. 1(B) is a perspective diagram of the interior construction of the prior art shield component.
Figure 2:
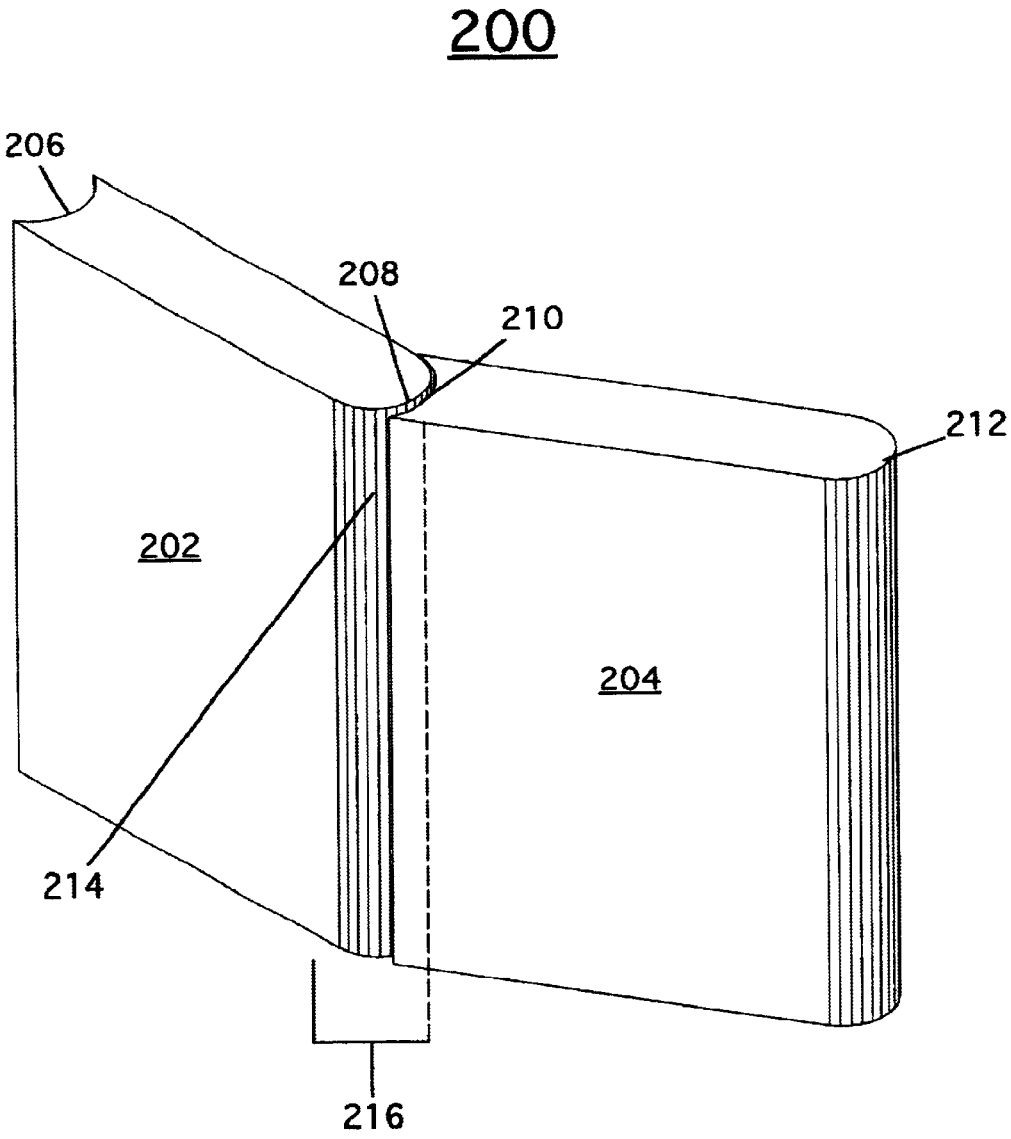
PRIOR ART FIG. 2
FIG. 2 is a perspective diagram of a prior art shielding wall using two prior art shield components.
Figure 3:
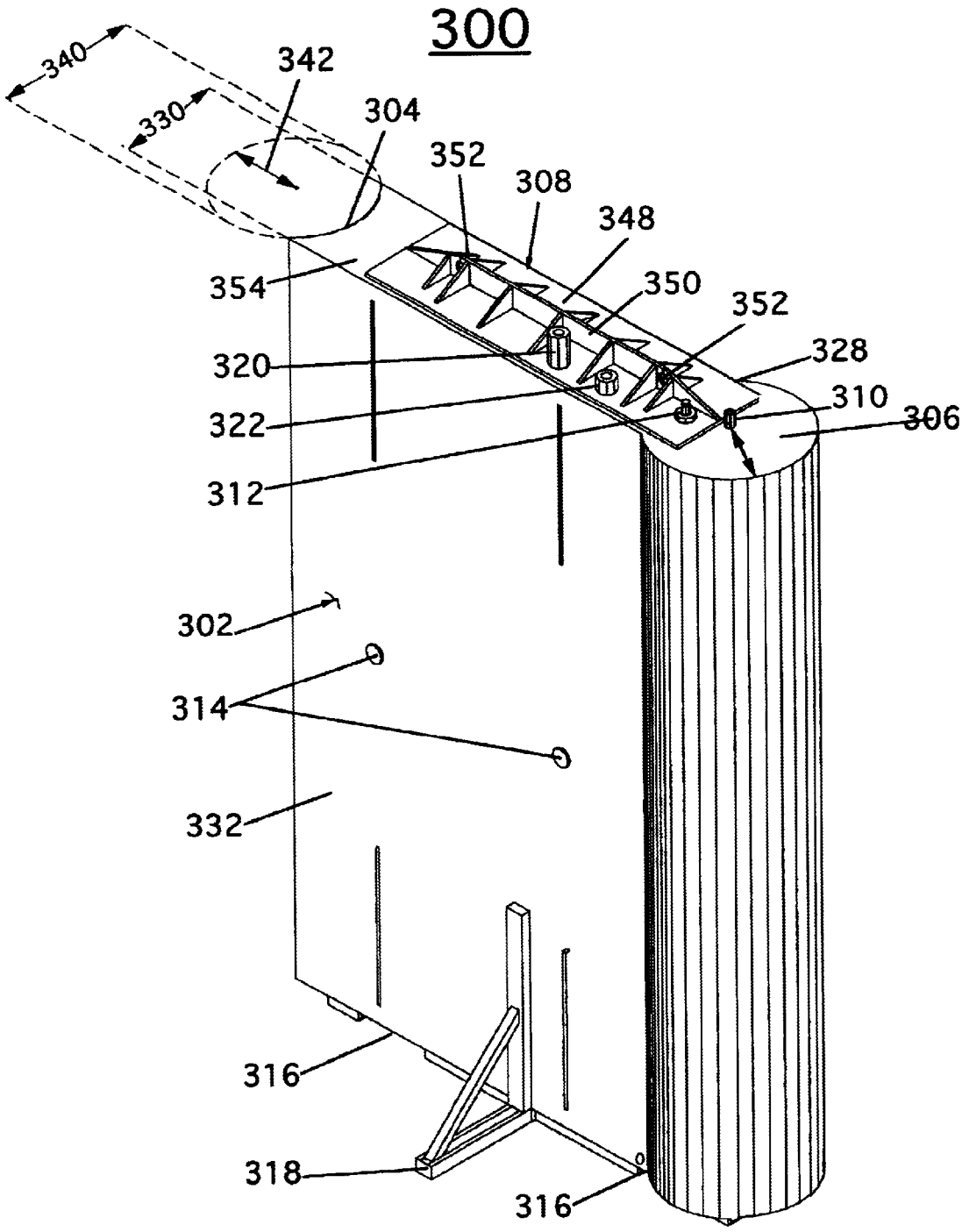
FIG. 3 is a perspective diagram of the exterior of a principal modular wall component of the present invention.
Figure 4:
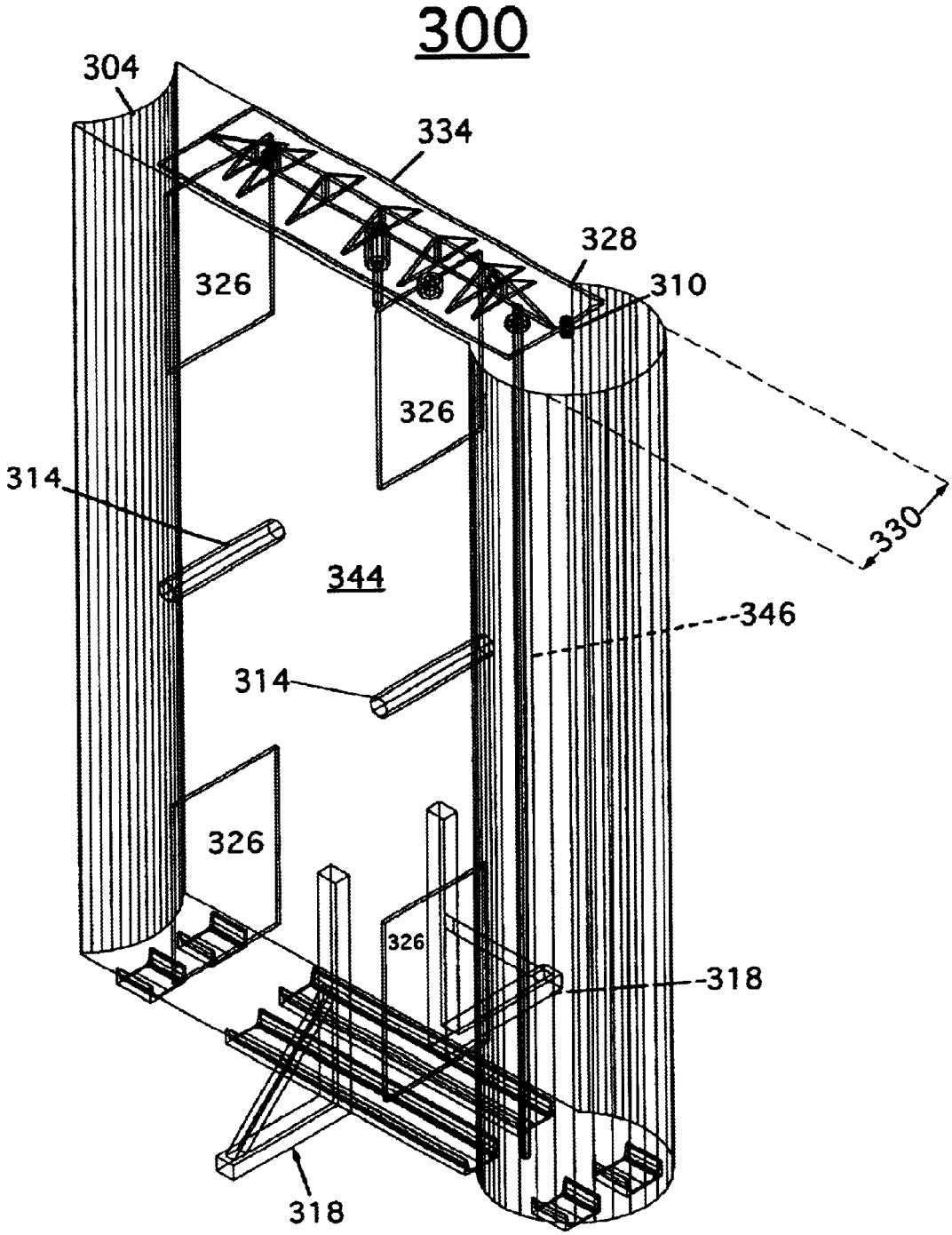
FIG. 4 is a perspective diagram of the interior construction of the principal modular wall component of the present invention.

The shielding system of the present invention is comprised of one or more modular wall components that can be interconnected to form a shielding wall of varying shape and size. The preferred modular wall component 300 is shown in FIGS. 3 and 4, wherein FIG. 3 shows the exterior of a modular wall component 300 and FIG. 4 shows the interior construction of a modular wall component 300. The modular wall component 300 is the principal modular wall component of the present invention and has a main container 302 being generally rectangular in shape having a first end 304, a second end 328, and a width, or thickness, 330. The rectangular shape of the main container 302 is for convenience, and it would be readily apparent to use another shape according to the target area sought to be protected, e.g., U-shaped.

The main container 302 is hollow such that it has an internal cavity 344 adapted to store a filler material. Possible filler material includes, but is not limited to, water, sand, concrete, composite material, or any radiation attenuating liquid. As a means for supporting the main container 302, one or more internal cross supports 314 and/or one or more cross panels 326 may be used to secure a front face 332 to a back face 334 of the main container 302. The preferred cross supports 314 are elongated bars or rods whereas the preferred cross panels 326 are rectangular panels. Both the cross supports 314 and the cross panels 326 secure the front face 332 to the back face 334 via conventional means (e.g., welding, adhesive, fasteners, clips, etc.), thereby making the main container 302 stronger during use and transport. The number and location of cross supports 314 and cross panels 326 is determined by the size of the modular wall component 300 being designed and built. Therefore, once the modular wall component 300 is filled with filler material, the main container 302 retains its intended shape.

A connector container 306 is an elongated cylinder, such as a tube, having a cross section that is generally circular in shape with a diameter 336 and radius 338, thereby making it a "locking end" of the main container 102. Preferably, the diameter 336 of the connector container 306 is greater than the width 330 of the main container 302. In addition, in the preferred embodiment, the ratio of the width 330 of the main container 302 to the diameter 336 of the connector container 306 is 1:1.42. This ratio is for convenience purpose only. It would be readily apparent to one of ordinary skill of the relevant art to use any diameter 336 of the connector container 306 as long as the diameter 336 is greater than the width 330 of the main container 302.

The connector container 306 is integrally connected to the second end 328 of the main container 302 such that an internal cavity 344 of the main container 302 is in communication with the internal cavity 346 of the connector container 306. Therefore, the connector container 306 also is adapted to store the filler material. As seen on FIGS. 3 and 4, the connector container 306 is attached to, or made an integral part of, the main container 302 such that the front face 332 and the back face 334 of the main container 302 each are in contact with the external surface of the connector container 306. In addition, the connector container 306 is connected to the main container 302 such that the entire length of the second end 328 of the main container 302 is positioned within the connector container 306, thereby ensuring that the entire width of the main container 302 is in contact with the connector container 306. Thus, in this embodiment, the modular wall component 300 is made of the main container 302 and the connector container 306.

On the top surface 354 of the modular wall component 300 at the connector container 306, a locking pin 310 is centrally located. The locking pin 310 is a circular protrusion that is used as a means for interconnecting two adjacent modular wall components 300. The locking pin 310 is centrally located on the connector container 306 for convenience purpose only. It can easily be positioned at any location on the top surface 354. In addition, the locking pin 310 may be fixed to the top surface 354 permanently, or may be removable. The use of the locking pin 310 is described in greater detail below.

The first end 304 of the main container 302 is preferably concave in shape with a diameter 340 and a radius 342, and adapted to correspond to the generally circular shape of the cross section of the connector container 306, such that the radius 338 of the connector container 306 is about equal to the radius 342 of the first end 304 of the main container 302. Therefore, the first end 304 becomes a "receiving end" for a connector container 306 of a second modular wall component 300.

The modular wall component 300 is preferably made from 3/16 of an inch thick airplane grade aluminum but this is for convenience purpose only. It is possible to make this modular wall component 300 using plastic, a composite material, steel, rubber, and any comparable material. In addition, the cross supports 314 and cross panels 326 are made of the same material as the main container 102 and the connector container 106. Also, the preferred dimensions of the modular wall component 300 are about 7 feet in height, about 77 inches in length, and about 12 inches in width (its thickness). These materials and dimensions are described for convenience purpose only. It would be readily apparent to one of ordinary skill in the relevant arts to design, manufacture and use a modular wall component 300 of the present invention using comparable materials and different dimensions.

The modular wall component 300 also has a means for lifting the modular wall component 300 for transport. A first way of lifting the modular wall component 300 is a lifting assembly 308 secured to the top surface 354 of the modular wall component 300. In the preferred embodiment, the lifting assembly 308 is a flat base 348 having on its top surface a vertical support structure 350 with one or more holes 352. Thus, in transport, a hook can be removably attached to the hole(s) 352 such that a crane can lift the modular wall component 300 and move it.

Also, in the preferred embodiment, the lifting assembly 308 is made of metal and is bolted to the top surface 354 of the modular wall component 300. The use of metal and bolts for the lifting assembly 308 is for convenience purpose only. It would be readily apparent to one of ordinary skill in the relevant art to use a comparable material and means for securing the base 348 to the modular wall component 300.

A second way of lifting a modular wall component 300 of the present invention is to engage the one or more lifting points 316 on the bottom of the modular wall component 300. The lifting points 316 are recessed areas sized and adapted such that the prongs of a conventional fork lift can be inserted into the lifting points 316. Thus, in transport, the fork lift inserts its prongs into the lifting points 316, then raises the prongs with the modular wall component 300 on top thereof, and moves the modular wall component 300 to a new location.

The modular wall component 300 also has a means for supporting the modular wall component 300 while it is free standing on a base surface, e.g., the ground. One such means is one or more removable base leg supports 318 that can be placed on one or both sides of the modular wall component 300 as shown in FIGS. 3 and 4. In this embodiment, the base leg supports 318 are removable from the modular wall component 300 such that they can be removed during transport. In an alternative embodiment, the base leg supports 318 may be secured to the modular wall component 300 by conventional means, e.g., welding, fasteners, clips, and the like.

The modular wall component 300 also includes a means for filling and draining the modular wall component 300 with filler material. In the preferred embodiment, this means for filling and draining comprises a fill and drain valve 312, a sight tube 320 for looking into the internal cavity 344 of the main container 302 of the modular wall component 300, and a pressure release valve 322 for use during filling and draining of the modular wall component 300. In operation, a user would open the pressure release valve 322 and fill the internal cavity 344 of the main container 302 and the internal cavity 346 of the connector container 306 with filler material by conventional means through the fill and drain valve 312. While checking the level of filler material in the internal cavity 344 visually through the sight tube 320, the user stops the flow of filler material when the desired level of filler material is reached. Once the modular wall component 300 is filled, the user closes the pressure release valve 322 and the fill and drain valve 312.

To drain the filler material from the modular wall component 300, the user opens the pressure release valve 322 then opens the fill and drain valve 312. The location of the fill and drain valve 312 dictates how the actual draining takes place. For example, as shown on FIGS. 3 and 4, the fill and drain valve 312 is located on the top surface 354 of the modular wall component 300, therefore, a conventional pump assembly is needed to pump the filler material out of the modular wall component 300. However, as shown on FIG. 5, one or more fill and drain valves 502 may be located on the front face 332 of the main container 302. For example, a fill and drain valve 502 may be positioned near the bottom of the main container 302. Therefore, upon opening the bottom fill and drain valve 502 and a pressure release valve 322, gravity will drain the filler material from the modular wall component 500.

Figure 5:
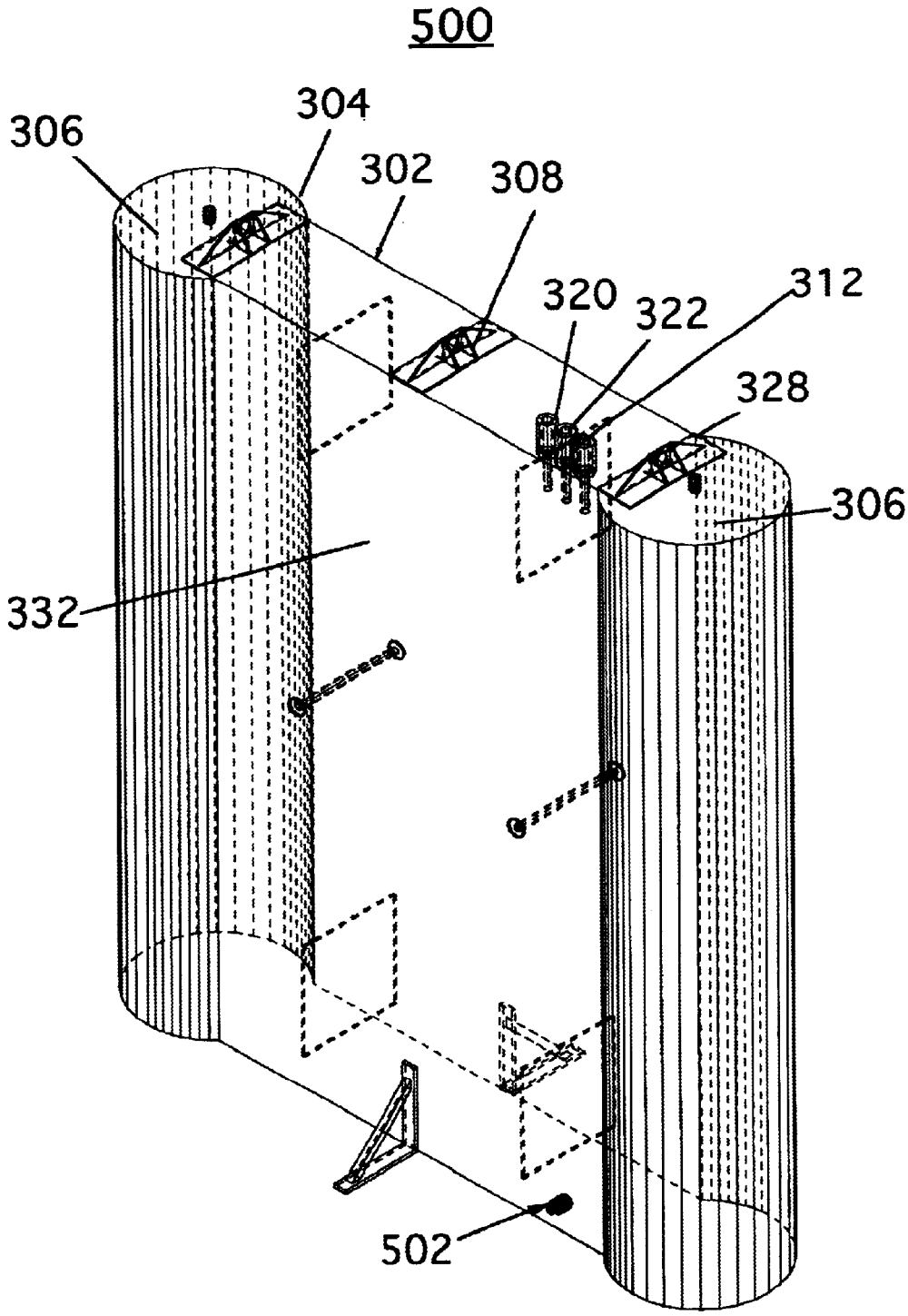
FIG. 5(A) is a perspective diagram of a second modular wall component of the present invention.
FIG. 5(B) is a planar diagram showing the front view of the second modular wall component.
FIG. 5(C) is a planar diagram showing the top view of the second modular wall component.
Figure 5:
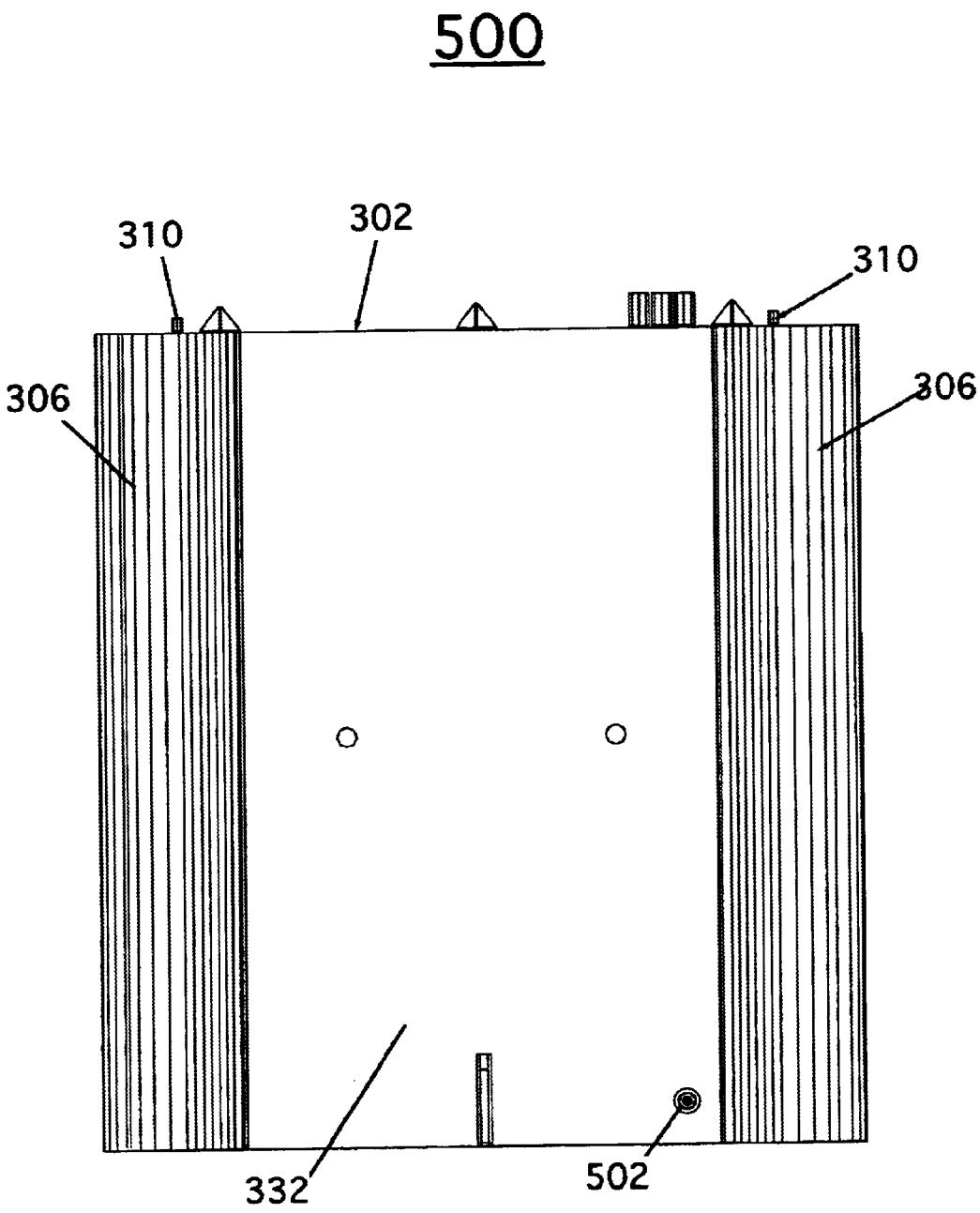
Figure 5:
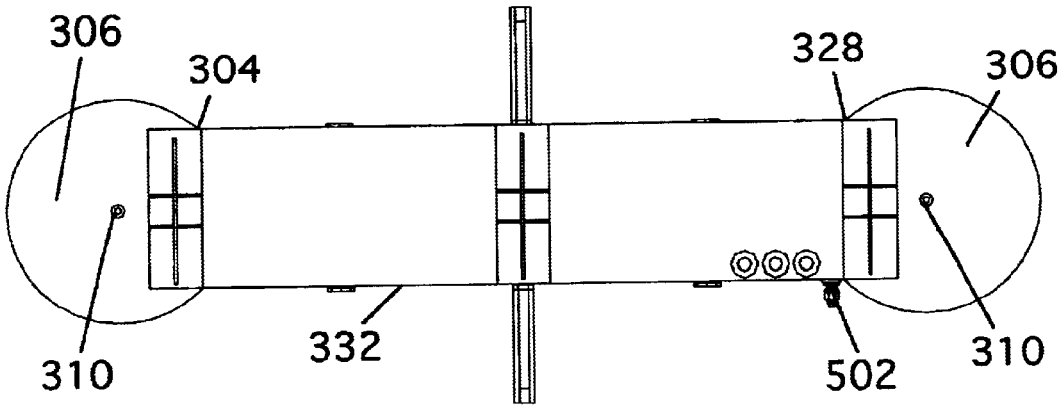
Figure 6:
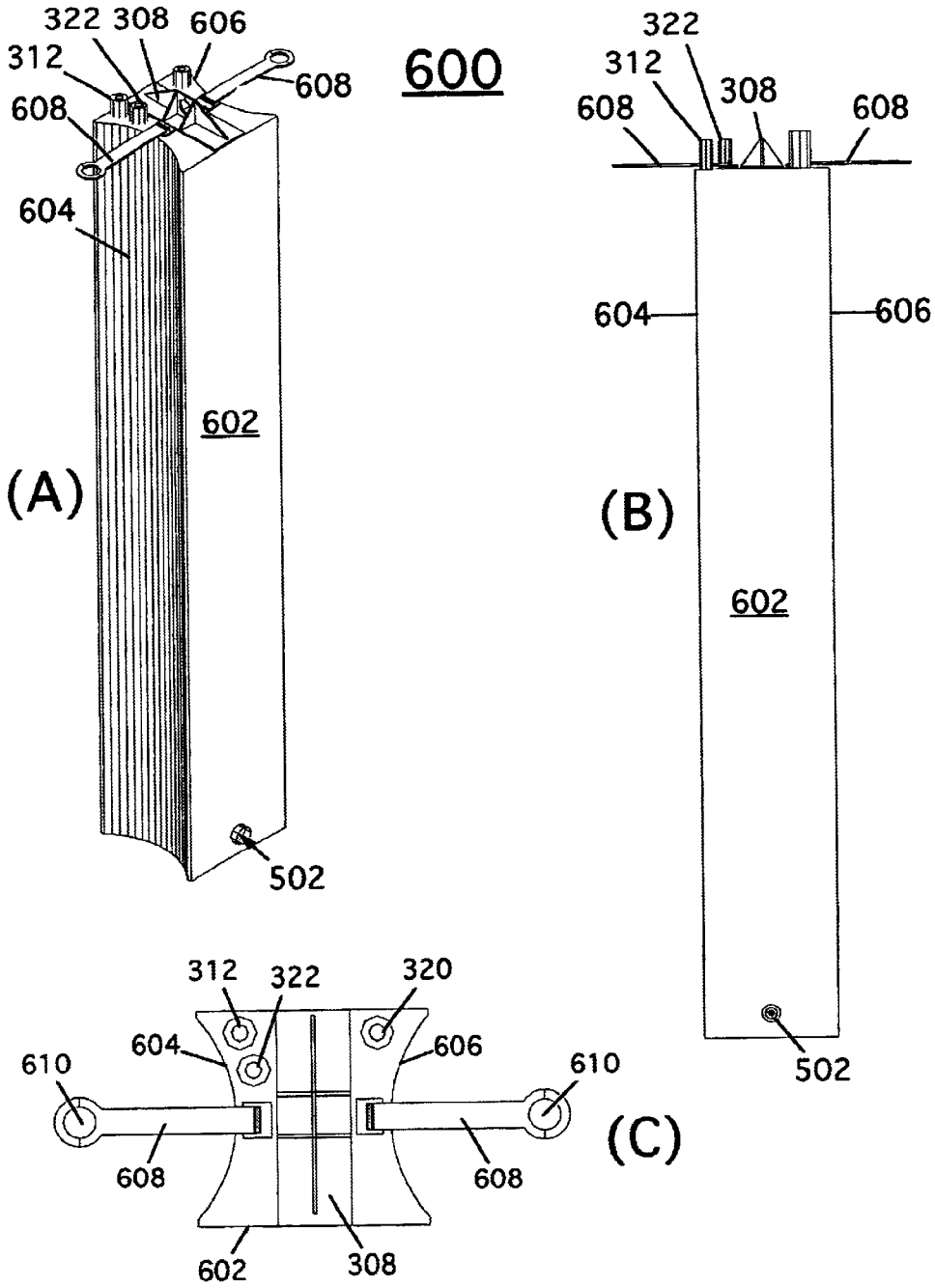
FIG. 6(A) is a perspective diagram of a third modular wall component of the present invention.
FIG. 6(B) is a planar diagram showing the front view of the third modular wall component.
FIG. 6(C) is a planar diagram showing the top view of the third modular wall component.
Figure 7:
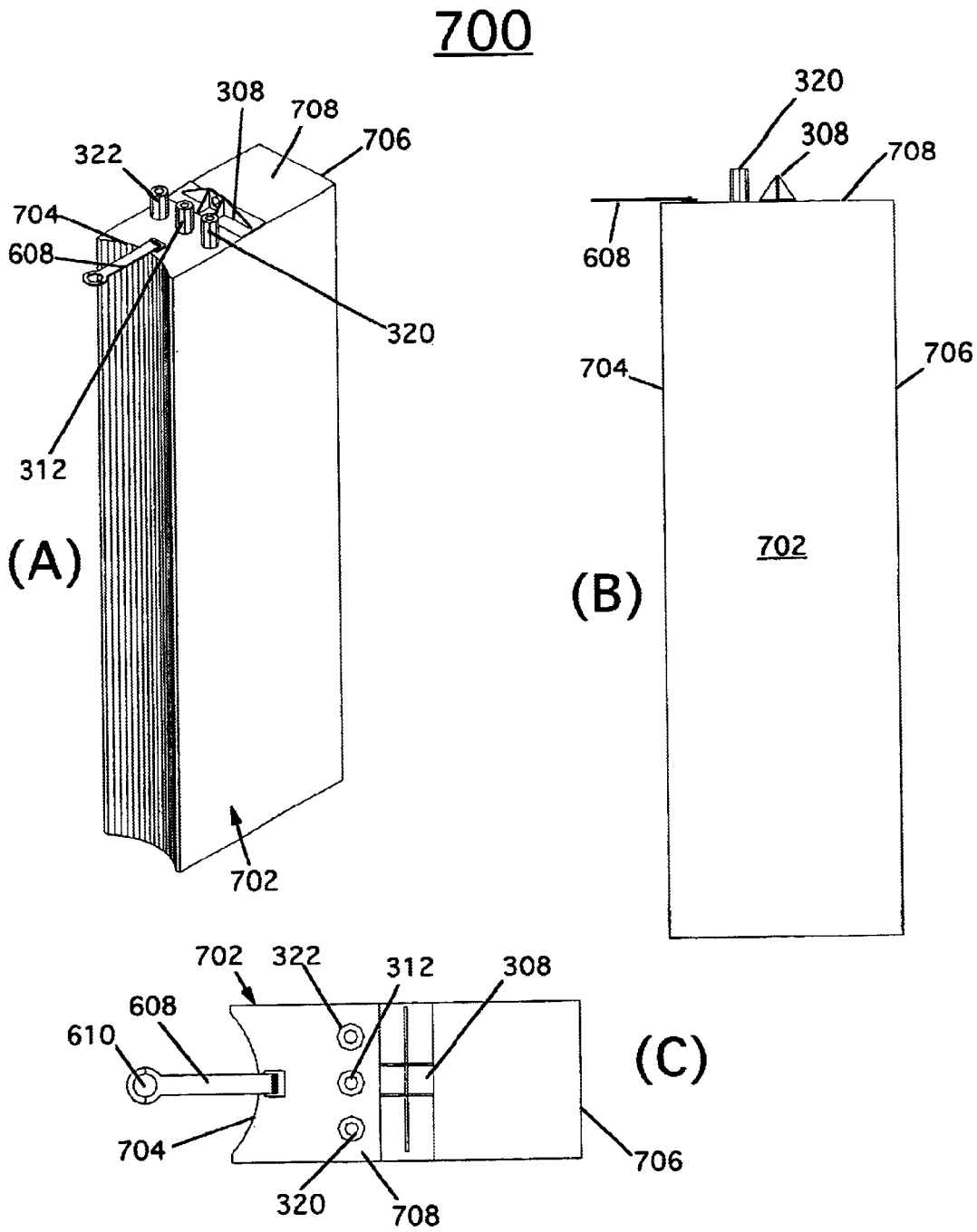
FIG. 7(A) is a perspective diagram of a fourth modular wall component of the present invention.
FIG. 7(B) is a planar diagram showing the front view of the fourth modular wall component.
FIG. 7(C) is a planar diagram showing the top view of the fourth modular wall component.

FIGS. 5–7 show different configurations for different components of the modular wall system of the present invention. The above description of modular wall component 300 and its features are equally applicable to each of these other components described below. In addition, these components are those of the preferred embodiment. It would be readily apparent to one of ordinary skill in the relevant art to use comparable components to design and build a portable shielding system of the present invention.

In FIGS. 5(A)–(C) a second modular wall component 500 has a connector container 306 at both the first end 304 and the second end 328 of the main container 302. In FIGS. 6(A)–(C), a third modular wall component 600 has a main container 602 wherein both its first end 604 and its second end 606 are receiving ends adapted for receiving a connector container 306 of another modular wall component, such as the principal modular wall component 300, as well as, the second modular wall component 500. In FIGS. 7(A)–(C), the fourth modular wall component 700 has a main container 702 rein a first end 704 is a receiving end adapted for receiving a connector container 306 of another modular wall component 300, and the second end 706 is a straight edge. This configuration of a second end 766 allows the fourth modular wall component 700 to be placed against a wall or other flat surface.

Figure 8:
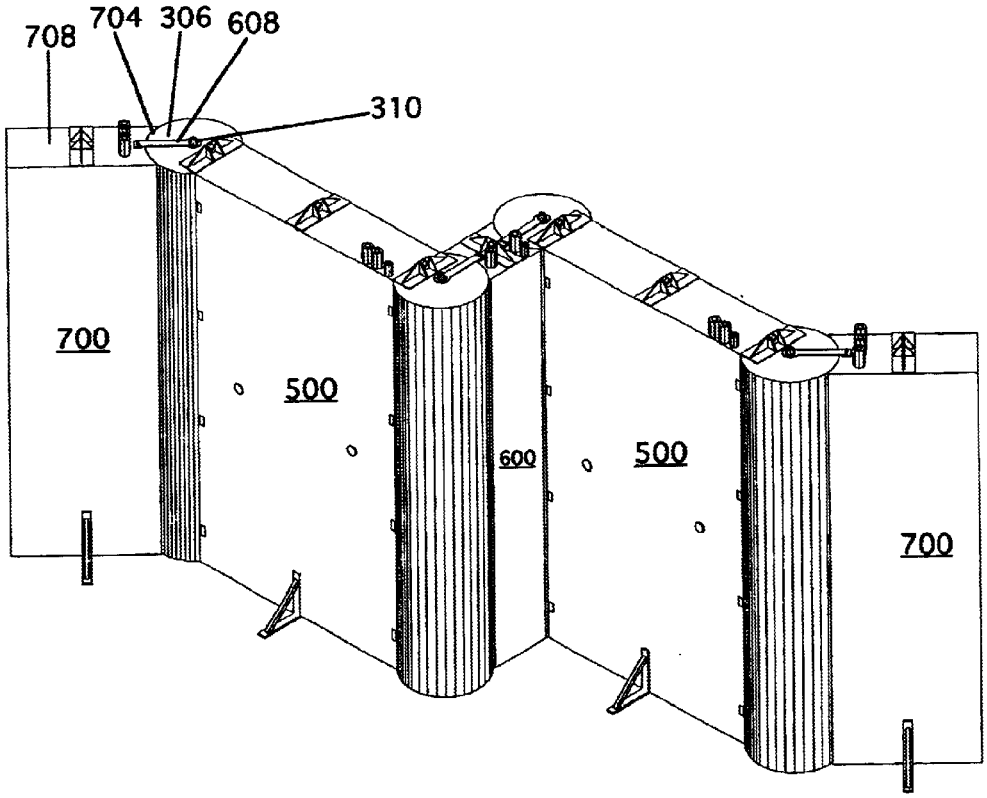
FIG. 8 is a perspective diagram showing a shielding wall of the present invention.
Figure 9:
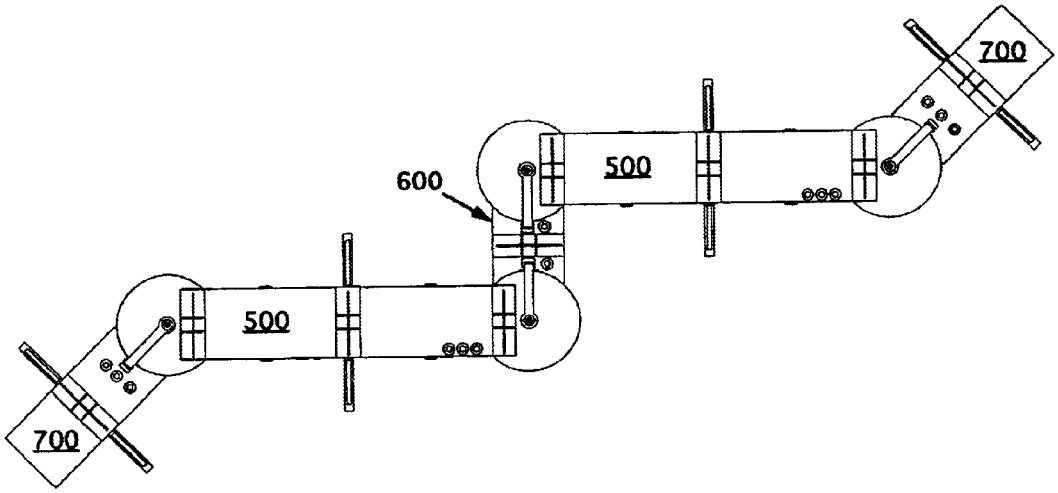
FIG. 9 is a planar diagram showing the top view of the shielding wall.
Figure 10:
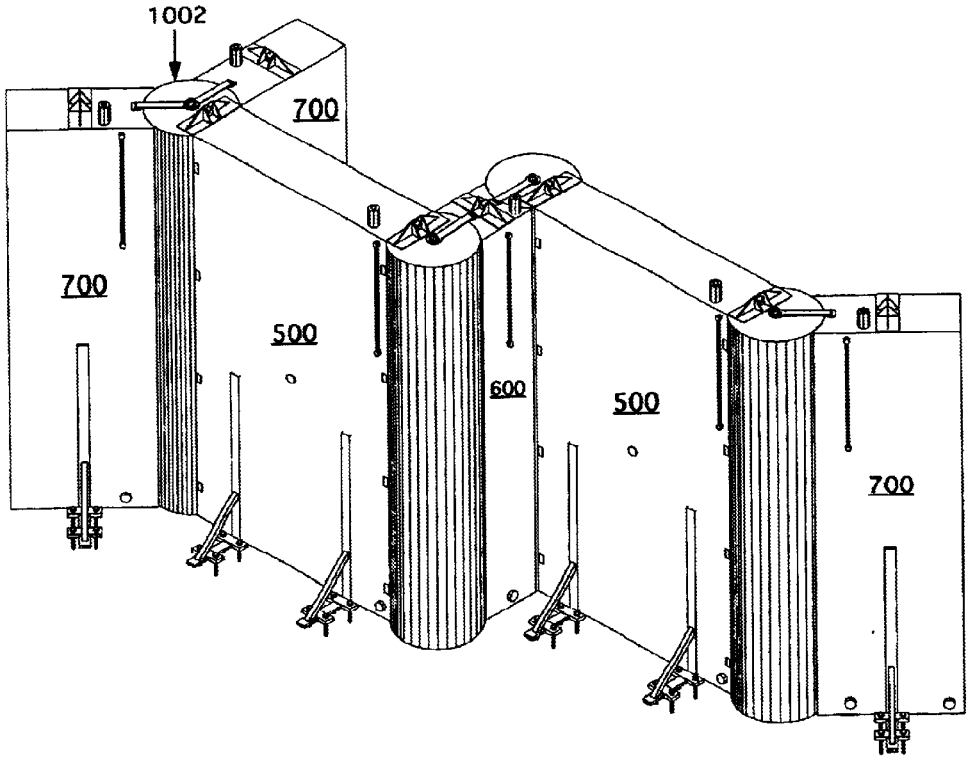
FIG. 10 is a perspective diagram showing an alternative shielding wall of the present invention.
Figure 11:
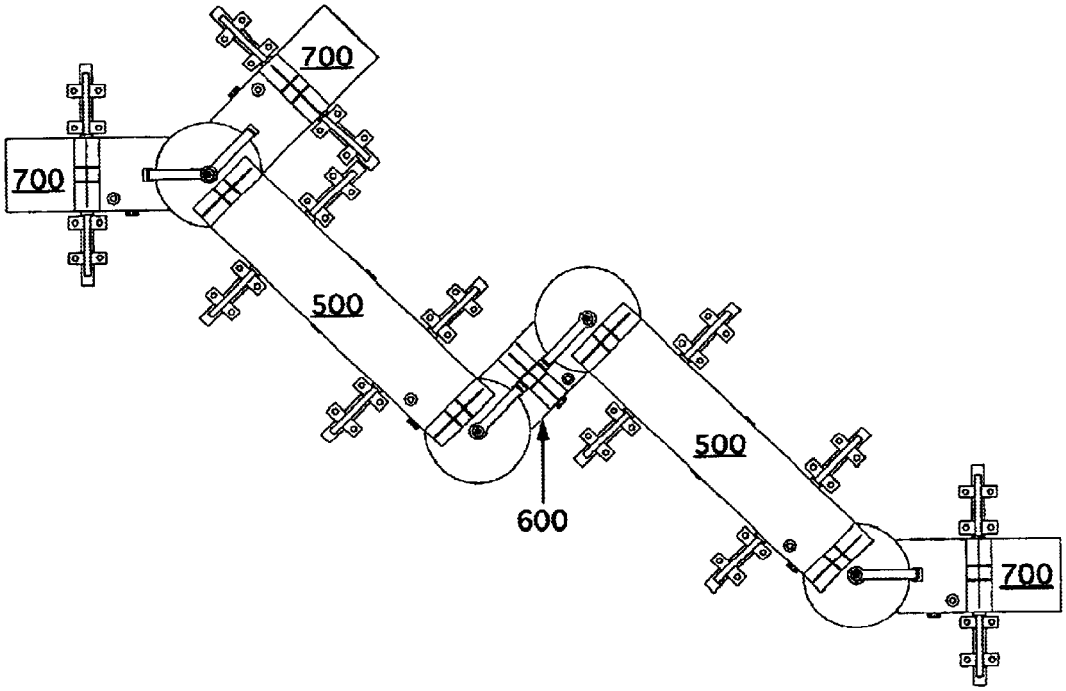
FIG. 11 is a planar diagram showing the top view of the alternative shielding wall.

FIGS. 8 and 9 show a portable shielding system of the present invention in which different modular wall components are joined together to form a shielding wall barrier 800. FIG. 8 is a perspective view, and FIG. 9 is a top view, of the shielding wall barrier 800. For example, as shown in these two figures, the shielding wall barrier 800 is composed of joining together, in the following order, a fourth modular wall component 700, a second modular wall component 500, a third modular wall component 600, a second modular wall component 500, and a fourth modular wall component 700. An alternative shielding wall barrier 1000 is shown in FIGS. 10 and 11, wherein a second fourth modular wall component 700 is added to a connector container 306 at joint 1002. Thus, it is readily apparent that the modularity of the wall components of the present invention provide the means for a user to build a custom designed wall according to his/her specific shielding needs.

Two adjacent modular wall components are secured together with a means for locking, which is best shown and described in FIGS. 6–11. Referring to FIGS. 8 and 9, in the preferred embodiment, a modular wall component, such as fourth modular wall component 700, has a means for locking, e.g., a locking pin assembly, pivotally attached to its top surface 708. As shown, the means for locking is a locking arm 608 pivotally connected to the top surface 708 of the fourth modular wall component 700 in proximity to the first end 704 of the fourth modular wall component 708 adapted to be a receiving end for receiving a connector container 306. The locking arm 608 has a hole 610 at its distal end. The connector container 306 of the adjacent second modular wall component 500 has a locking arm pin 310 located at about the center point of the top surface of the generally circular connector container 306 of one end of the second modular wall component 500. Therefore, in operation, the connector container 306 of the second modular wall component 500 is placed within the first end 704 of the fourth modular wall component 700. Once in position, the locking arm 608 of the fourth modular wall component 700 is swung over the connector container 306 of the fourth modular wall component 700 and the hole 610 of the locking arm 608 is placed over the locking arm pin 310, thereby securing the fourth modular wall component 700 with the second modular wall component 500. The locking arm 608 has a preferred length that is slightly larger than the radius of a connector container 306 in order to prevent the connector container 306 of the second modular wall component 500 from rotating too freely within the first end 704, or receiving end, of the fourth modular wall component 700.

The principal advantage of the present invention is that when a shielding system 800 is assembled, the joints of the shielding system 800, which is the location where each connector container 306 is fit within a receiving end of another modular wall component, has the same thickness or depth of protection as the main containers 302. This "ball and socket" design also allows a shielding system 800 to be quickly and easily deployed in almost any pattern or configuration while maintaining maximum protection at the joints. The "ball and socket" joints allow two adjacent modular components to rotate as much as 90 degrees to each other—enabling virtually any angle between the two components. This is an advantage when using the shielding system 800 as a radiation shield to protect workers from unwanted nuclear radiation. Although described in terms of radiation protection, the shielding system of the present invention can also be used as a highway water barrier, construction, or in any other area requiring a portable wall.

FIGS. 10 and 11 are a perspective and planer top view diagrams of an alternative shielding system 1000 showing two first ends 704, or receiving ends, of two different fourth modular wall components 700 connected with the same connector container 306 of a second modular wall component 500, thereby creating a "Y-shaped" joint 1002. In this embodiment, both locking arms 608 (the locking arm 608 of the first fourth modular wall component 700 and the locking arm 608 of the second fourth modular wall component 700) are secured to the locking pin 310 of the connector container 306 of the second modular wall component 500. This feature of being able to construct Y-shaped joints, e.g., joint 1002, allows a user to design and build a shielding system 1000 of almost any imaginable pattern.

In an alternative shielding system of the present invention, each of the modular wall components, such as components 300, 500, 600, and 700, is not adapted to receive a filler material, but rather, each wall component is made of a solid material, e.g., concrete, a stone composition, or a composite material, having radiation attenuating properties. This alternative embodiment of wall components eliminates the need for containers (or any outer shell), internal supports, such as cross supports 314 and the cross panels 326, and external supports, such as leg supports 318, because the components are free-standing, solid forms. However, this embodiment preferably has one or more internal supports for the internal structure of the components, e.g., one or more re-bar supports as used in conventional concrete construction.

Figure 12:
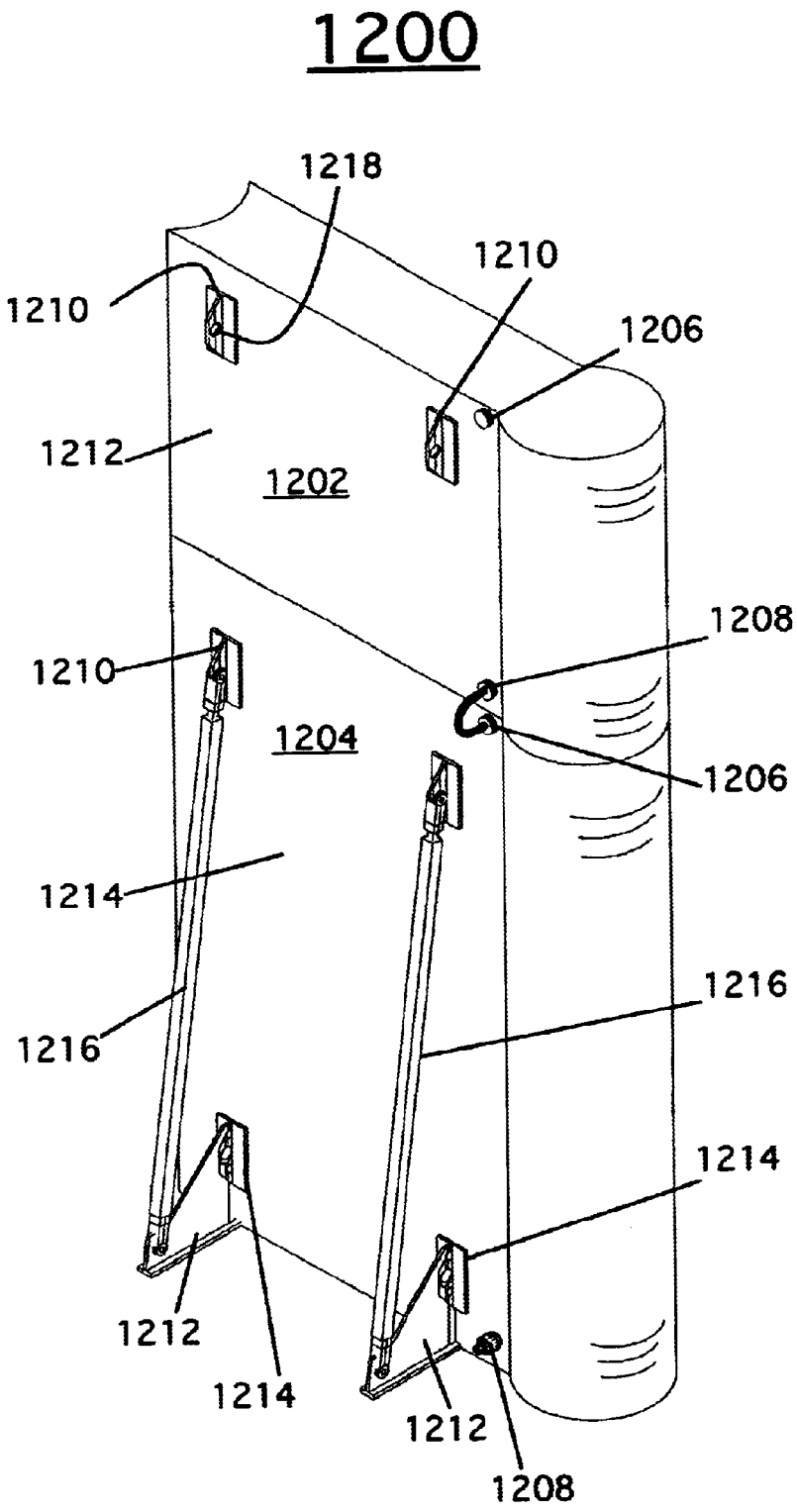
FIG. 12 is a perspective diagram showing a second alternative shielding wall.

FIG. 12 is a perspective diagram showing a second alternative shielding wall 1200 wherein a first principal modular wall component 1202 is stacked on top of a second principal modular wall component 1204. In this embodiment, the lifting assembly 308 described above is not attached to the top surface 354 of the second principal modular wall component 1204, thereby allowing the first principal modular wall component 1202 to be placed on top. Also, in this embodiment, the first and second principal modular wall components 1202, 1204 have a top fill and drain valve 1206 and a bottom fill and drain valve 1208, both of which are positioned on the front faces 1212, 1214 of the principal modular wall components 1202, 1204.

In operation, the bottom fill and drain valve 1208 of the first principal modular wall component 1202 is connected to the top fill and drain valve 1206 of the second principal modular wall component 1204 via a conventional hose. A user then attaches a conventional hose to the bottom fill and drain valve 1208 of the second principal modular wall component 1204 to fill both principal modular wall components 1202, 1204 with water. To disassemble the shielding wall 1200, the user opens the bottom fill and drain valve 1208 of the second principal modular wall component 1204 to drain both principal modular wall components 1202, 1204.

In addition, the means for lifting a principal modular wall component 1202, 1204 in this shielding system 1200 is one or more attachment flanges 1210 secured to the front face 1212 of the first principal modular wall component 1202 and the front face 1214 of the second principal modular wall component 1204. Using a hook and line, a crane attaches to the hole 1218 in one or more of the attachment flanges 1210 in order to lift and transport the principal modular wall component 1202, 1204.

Also shown in FIG. 12 is an alternative means for supporting a principal modular wall component 1204 while it is free standing on a base surface, e.g., the ground. This means is one or more removable leg support bars 1216 that can be placed on one or both sides of the principal modular wall component 1204. In this embodiment, the top end of each leg support bar 1216 is connected to the attachment flanges 1210 on the front face 1214 of the principal modular wall component 1204 via a mechanical fastener, e.g., a bolt or pin. The bottom end of each leg support bar 1216 is connected to the distal end of a leg support base 1212 also by a mechanical fastener, e.g., a bolt or pin. The leg support base 1212 is secured to a leg support plate 1214 which is welded or otherwise secured to the front face 1214 of the principal modular wall component 1204. These leg support bars 1216 and leg support bases 1212 are removable from the principal modular wall component 1204, such as for transport, by simply removing the fasteners.

Figure 13:
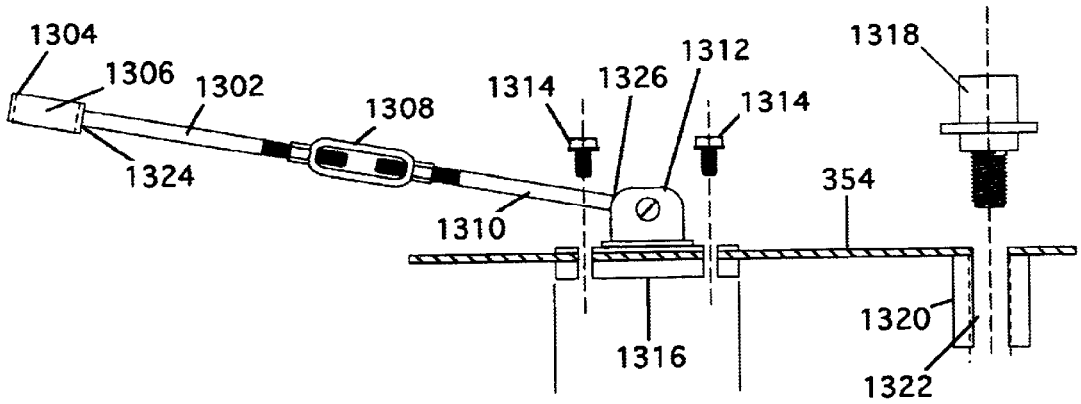
FIG. 13 is a planar side view of an alternative locking pin assembly of the present invention.

FIG. 13 is a planar side view of an alternative locking pin assembly of the present invention for locking together two adjacent modular wall components, such as two modular wall components 300, with a locking pin 1302 having a first end 1324 and a second end 1326. In this embodiment, the top surface 354 of a modular wall component 300 is shown. On one end, such as on the first end 304, or receiving end, of the modular wall component 300, a lock fastener 1312 is bolted to the top surface 354 by one or more bolts 1314. A lock fastener support 1316 is secured to the underside of the top surface 354 under the lock fastener 1312 in order to provide additional strength and support to the lock fastener 1312. The second end 1326 of a locking arm 1302 is secured to the lock fastener 1312 by a bolt, pin or other mechanical fastener. An engaging member 1304 with a hole 1306 is located on the first end 1324 of the locking pin 1302. The locking pin 1302 is an elongated bar 1310 having a locking member 1308 centrally disposed on the elongated bar 1310. The engaging member 1304 is used to interconnect and secure one modular wall component, such as modular wall component 300, to an adjacent one.

Also on the top surface 354 of the modular wall component 300 is a removable locking pin 1318. The removable locking pin 1318 is threaded on its bottom so that it can be removably secured within a locking pin hole 1322 in a locking pin hole base 1320 secured underneath the top surface 354 of the modular wall component. The locking pin 1318 is used to interconnect and secure the one modular wall component, such as modular wall component 300, to a second adjacent one. The lock fastener 1312 and removable locking pin 1318 are removable from the top surface 354 so that the modular wall components 300 can be vertically stacked.

In operation, a connector container 306 of a first modular wall component 300 is positioned within the receiving end 304 of a second modular wall component 300. After the second end 1326 of a locking arm 1302 is secured to the lock fastener 1312 of the second modular wall component 300, the engaging member 1304 of the locking arm 1302 is slipped over the removable locking pin 1318 of the first modular wall component 300. The diameter of the hole 1306 in the engaging member 1304 is slightly larger than the diameter of the locking pin 1318. Once the locking arm 1302 is in place, the locking member 1308 is tightened by turning it, thereby securing the first modular wall component 300 to the second modular wall component 300.

The present invention is described in these terms for convenience purpose only. It would be readily apparent for one of ordinary skill in the art to design and manufacture a comparable shielding system. Also, enough detail is provided herein to allow one of ordinary skill in the art to make and use the present invention.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined. Thus, the breadth and scope of the present invention should not be limited by any of the above-described exemplary embodiments.

What is claimed is:

1. A modular wall component, comprising:

a main container having a first end, a second end, and a width; and a connector container being an elongated cylinder having a cross section that is generally circular in shape with a diameter and radius, said connector container being integrally connected to said second end of said main container, and said diameter of said connector container being greater than said width of said main container, such that said second end is a locking end.

2. The modular wall component according to claim 1, wherein said first end of said main container is concave in shape with a diameter and a radius, and adapted to correspond to the generally circular shape of the cross section of said connector container, such that said radius of said connector-container is about equal to said radius of said connector container, such that said first end of said main container is a receiving end for said connector container.

3. The modular wall component according to claim 1, further comprising a second connector container being an elongated cylinder having a cross section that is generally circular in shape and being integrally connected to said first end of said main container, said diameter of said second connector container being greater than said width of said main container.

4. The modular wall component according to claim 1, wherein said first end is a straight edge.

5. The modular wall component according to claim 1, wherein said connector container is connected to said second end of said main container such that all of the width of said main container at said second end is in contact with said connector container.

6. The modular wall component according to claim 3, wherein said second connector container is connected to said first end of said main container such that all of the width of said main container at said first end is in contact with said second connector container.

7. The modular wall component according to claim 1, further comprising a means for lifting the modular wall component.

8. The modular wall component according to claim 1, further comprising a means for supporting the modular wall component on a base surface.

9. The modular wall component according to claim 1, further comprising a means for locking the modular wall component with a second modular wall component such that said connector container of said modular wall component is positioned within a receiving end of said second modular wall component.

10. The modular wall component according to claim 9, wherein said means for locking is a locking arm pivotally connected to a top surface of a main container of said second modular wall component in proximity to a first end of said second modular wall component and having a hole at a distal end, and said main container of the modular wall component having a locking pin located on a top surface of said connector container.

11. The modular wall component according to claim 10, wherein said locking arm has a length slightly larger than the radius of said connector container of said modular wall component.

12. The modular wall component according to claim 1, wherein said main container and said connector container are adapted to store a filler material.

13. The modular wall component according to claim 12, wherein said filler material is selected from the group consisting of water, sand, concrete, composite material, and a radiation attenuating liquid.

14. The modular wall component according to claim 12, further comprising a means for filling and draining the modular wall component.

15. The modular wall component according to claim 14, wherein said means for filling and draining the modular wall component is located on a front face of said main container.

16. The modular wall component according to claim 12, further comprising a means for visually indicating a level of said filler material contained within the modular wall component.

17. The modular wall component according to claim 1, wherein said main container and said connector container are each made of a solid material.

18. The modular wall component according to claim 17, wherein said solid material is selected from the group consisting of concrete, stone composition, and composite material.

19. The modular wall component according to claim 1, further comprising a means for stacking a second modular wall component on top of the modular wall component.

20. The modular wall component according to claim 19, wherein the modular wall component is adapted to store a filler material and further comprises a means for filling and draining located on a front face of said main container of the modular wall component, wherein said second modular wall component is adapted to store a filler material and further comprises a means for filling and draining located on a front face of a main container of said second modular wall component, and wherein said means for filling and draining the modular wall component is in communication with said means for filling and draining said second modular wall component.

21. The modular wall component according to claim 1, wherein said main container is generally rectangular in shape.

22. A modular wall component, comprising:

a main container being generally rectangular in shape having a first end, a second end, and a width, wherein said first end is concave in shape with a diameter and a radius and is adapted to correspond to a generally circular shape of a cross section of a connector container of a second modular wall component, said connector container being an elongated cylinder integrally connected to a main container of said second modular wall component and having a cross section that is generally circular in shape with a diameter and radius, such that said radius of said connector container is about equal to said radius of said first end of said main container of the modular wall component and said diameter of said connector container being greater than said width of said main container of the modular wall component, thereby said first end of said main container being a receiving end for said connector container of said second modular wall component.

23. The modular wall component according to claim 22, wherein said second end of said main container is concave in shape with a diameter and a radius, and adapted to correspond to the generally circular shape of the cross section of said connector container of said second modular wall component, such that said radius of said connector container is about equal to said radius of said second end of the modular wall component, thereby said second end of said main container of the modular wall component being a receiving end for said connector container of said second modular wall component.

24. The modular wall component according to claim 22, further comprising a connector container being an elongated cylinder having a cross section that is generally circular in shape and being integrally connected to said second end of said main container, said diameter of said connector container being greater than said width of said main container.

25. The modular wall component according to claim 22, wherein said second end is a straight edge.

26. The modular wall component according to claim 24, wherein said connector container is connected to said second end of said main container such that all of the width of said main container at said second end is in contact with said connector container.

27. The modular wall component according to claim 22, further comprising a means for lifting the modular wall component.

28. The modular wall component according to claim 22, further comprising a means for supporting the modular wall component on a base surface.

29. The modular wall component according to claim 22, further comprising a means for locking the modular wall component with a second modular wall component such that a connector container of a main container of said second modular wall component is positioned within said receiving end of the modular wall component.

30. The modular wall component according to claim 29, wherein said means for locking is a locking arm pivotally connected to a top surface of said main container of the modular wall component in proximity to said first end of said main container and having a hole at a distal end, and said second modular wall container having a locking pin located on a top surface of said connector container of said second modular wall component.

31. The modular wall component according to claim 30, wherein said locking arm has a length slightly larger than the radius of said connector container of said second modular wall component.

32. The modular wall component according to claim 22, wherein said main container is adapted to store a filler material.

33. The modular wall component according to claim 32, wherein said filler material is selected from the group consisting of water, sand, concrete, composite material, and a radiation attenuating liquid.

34. The modular wall component according to claim 32, further comprising a means for filling and draining the modular wall component.

35. The modular wall component according to claim 34, wherein said means for filling and draining the modular wall component is located on a front face of said main container.

36. The modular wall component according to claim 32, further comprising a means for visually indicating a level of said filler material contained within the modular wall component.

37. The modular wall component according to claim 22, wherein said main container is made of a solid material.

38. The mod all component according to claim 37, wherein said solid material is selected from the group consisting of concrete, stone composition, and composite material.

39. The modular wall component according to claim 22, further comprising a means for stacking a second modular wall component on top of the modular wall component.

40. The modular wall component according to claim 39, wherein the modular wall component is adapted to store a filler material and further comprises a means for filling and draining located on a front face of said main container of the modular wall component, wherein said second modular wall component is adapted to store a filler material and further comprises a means for filling and draining located on a front face of a main container of said second modular wall component, and wherein said means for filling and draining the modular wall component is in communication with said means for filling and draining said second modular wall component.

41. A shielding wall, comprising:

a first modular wall component comprising:

a main container having a first end, a second end, and a width; and a connector container being an elongated cylinder having a cross section that is generally circular in shape with a diameter and radius, said connector container being integrally connected to said second end of said main container, and said diameter of said connector container being greater than said width of said main container, such that said second end is a locking end;

a second modular wall component, comprising:

a main container being generally rectangular in shape having a first end, a second end, and a width, wherein said first end is concave in shape with a diameter and a radius and is adapted to correspond to the generally circular shape of the cross section of said connector container of said first modular wall component, thereby said first end of said main container of said second modular wall component being a receiving end for said connector container of said first modular wall component; and a means for connecting said first modular wall component to said second modular wall component wherein said connector container of said first modular wall component is positioned within said receiving end of said second modular wall component.

42. The shielding wall according to claim 41, wherein said first modular wall component and said second modular wall component are adapted to store a filler material.

43. The shielding wall according to claim 42, wherein said filler material is selected from the group consisting of water, sand, concrete, composite material, and a radiation attenuating liquid.

44. The shielding wall according to claim 42, wherein said first modular wall component and said second modular wall component further comprise a means for filling and draining.

45. The shielding wall according to claim 42, wherein said first modular wall component and said second modular wall component further comprise a means for visually indicating a level of said filler material.

46. The shielding wall according to claim 41, wherein said first modular wall component and said second modular wall are each made of a solid material.

47. The shielding wall according to claim 46, wherein said solid material is selected from the group consisting of concrete, stone composition, and composite material.

48. A shielding wall, comprising:

a first modular wall component comprising:

a first main container having a first end, a second end, and a width; and a first connector container being an elongated cylinder having a cross section that is generally circular in shape with a diameter and radius, said first connector container being integrally connected to said second end of said first main container, and said diameter of said first connector container being greater than said width of said first main container, such that said second end is a locking end;

a second modular wall component, comprising:

a second main container having a first end, a second end, and a width; and a second connector container being an elongated cylinder having a cross section that is generally circular in shape with a diameter and radius said second connector container being integrally connected to said second end of said second main container, and said diameter of said second connector container being greater than said width of said second main container, such that said second end is a locking end; and a means for stacking said first modular wall component on top of said second modular wall component.

49. The shielding wall according to claim 48, wherein said first modular wall component and said second modular wall component are adapted to store a filler material.

50. The shielding wall according to claim 49, wherein said filler material is selected from the group consisting of water, sand, concrete, composite material, and a radiation attenuating liquid.

51. The shielding wall according to claim 49, wherein said first modular wall component and said second modular wall component further comprise a means for filling and draining.

52. The shielding wall according to claim 51, wherein said means for filling and draining is a fill and drain valve, and said fill and drain valve of said first modular wall component is in communication with said fill and drain valve of said second modular wall component.

53. The shielding wall according to claim 49, wherein said first modular wall component and said second modular wall component further comprise a means for visually indicating a level of said filler material.

54. The shielding wall according to claim 48, wherein said first modular wall component and said second modular wall are each made of a solid material.

55. The shielding wall according to claim 46, wherein said solid material is selected from the group consisting of concrete, stone composition, and composite material.

* * * * *